US005541627A

United States Patent [19]

Quate

[11] Patent Number: 5,541,627

[45] Date of Patent: Jul. 30, 1996

[54] METHOD AND APPARATUS FOR EJECTING A DROPLET USING AN ELECTRIC FIELD

[75] Inventor: Calvin F. Quate, Stanford, Calif.

[73] Assignee: Xerox Corporation, Stamford, Conn.

[21] Appl. No.: 809,191

[22] Filed: Dec. 17, 1991

[51] Int. Cl.[6] ..... B41J 29/38; B41J 2/135

[52] U.S. Cl. ..... 347/10; 347/46

[58] Field of Search ..... 346/1.1, 140 R, 346/75; 347/44, 46, 55, 9, 10, 20

[56] References Cited

U.S. PATENT DOCUMENTS

| | | | |
|---|---|---|---|
| 4,383,265 | 5/1983 | Kohashi | 346/140 |
| 4,717,926 | 1/1988 | Hotomi | 346/140 R |
| 4,719,476 | 1/1988 | Elrod et al. | 346/140 R |
| 4,719,480 | 1/1988 | Elrod et al. | 346/140 |

OTHER PUBLICATIONS

W. Eisenmenger entitled "Dynamic Properties of the Surface Tension of Water and Aqueous Solutions of Surface Active Agents with Standing Capillary Waves in the Frequency Range From 10 kc/s to 1.5 Mc/s," pp. 327–340 of vol. 9, of Acustica, 1959.

*Primary Examiner*—Peter S. Wong
*Assistant Examiner*—Eric Frahm
*Attorney, Agent, or Firm*—John M. Kelly

[57] ABSTRACT

A method and apparatus for ejecting droplets from the crests of capillary waves riding on the free surface of a liquid by parametrically pumping the capillary waves with electric fields from probes located near the crests. Crest stabilizers are beneficially used to fix the spatial locations of the capillary wave crests near the probes. The probes are beneficially switchably connected to an AC voltage supply having an output that is synchronized with the crest motion. When the AC voltage is applied to the probes, the resulting electric field adds sufficient energy to the system so that the surface tension of the liquid is overcome and a droplet is ejected. The AC voltage is synchronized such that the droplet is ejected about when the electric field is near is minimum value. A plurality of droplet ejectors are arranged and the AC voltage is switchably applied so that ejected droplets form a predetermined image on a recording surface.

11 Claims, 4 Drawing Sheets

METHOD AND APPARATUS FOR EJECTING A DROPLET USING AN ELECTRIC FIELD

The present invention relates to droplet ejectors. More particularly, it relates to methods and devices for ejecting droplets from crests of capillary waves on the free surface of a liquid by parametrically pumping the liquid with an electric field, and the use of those methods and devices in drop-on-demand printers.

BACKGROUND OF THE INVENTION

Many types of printers have been developed. The best printer to use in a particular application depends on factors such as the printer's relative cost, reliability, availability, speed, recording medium, and marking techniques. However, when direct marking on a recording medium is required, drop-on-demand printers are an appropriate choice.

Numerous kinds of drop-on-demand printers are either available or under development. For example, nozzle-based ink jet printers which emit ink through a small nozzle or orifice have been available for some time. Despite the work that has gone into developing these printers, they remain subject to various problems such as nozzle clogging; high production costs, which is at least partially a result of the difficulty in producing the nozzles; and image smearing, a result of using slowly drying ink to reduce clogging. While various solutions to these and other problems have been implemented or proposed, experience suggests that nozzle-based ink jet printers are not optimum.

In view of the above, other types of drop-on demand printers have been proposed. Far example, Kohashi in U.S. Pat. No. 4,383,265, issued 10 May 1983, disclosed an electroosmotic ink recording apparatus potentially usable for drop on demand printing. The '265 patent teaches the wicking of ink over an electrode using electroosmosis and the subsequent inducing of ink to jump from the wick onto a recording surface by using coulomb forces developed via a second electrode behind the recording medium While the technology found in the '265 patent may avoid some of the problems with nozzle-based printers, its teachings have not achieved wide spread use.

In any event, other drop-on-demand print technologies are being developed. One such technology of special interest to the present invention involves the use of capillary waves, specifically as taught in U.S. Pat. Nos. 4,719,476 and 4,719,480, respectively entitled "Spatially Addressing Capillary Wave Droplet Electors and the Like," and "Spatial Stabilization of Standing Capillary Surface Waves." Both patents issued to inventors Elrod, Khuri-Yakub, and Quate on 12 Jan. 1988, and both are hereby incorporated by reference.

U.S. Pat. No. 4,719,480 teaches methods and devices for spatially stabilizing the crests of capillary waves on the free surface of a liquid, such as ink, while U.S. Pat. No. 4,719,476 discloses methods and devices emitting droplets from the crests of capillary waves. In particular, U.S. Pat. No. 4,719,476 discusses ejecting droplets from the crests using acousticaily induced secondary capillary waves, heaters, laser beams, and ions. These techniques for ejecting droplets from capillary waves may not be optimum.

What is needed are easily implemented methods and devices for inducing droplets to be ejected from the crests of capillary waves. Such methods and devices would be particularly useful in drop-on-demand printers.

BRIEF SUMMARY OF THE INVENTION

The present invention provides for parametrically pumping droplets from the crests of capillary waves using electric fields. Capillary waves are generated on the free surface of a liquid, beneficially by using acoustical energy, at a level approaching the onset of droplet ejection (see Eisenmenger, "Dynamic Properties of the Surface Tension of Water and Aqueous Solutions of Surface Active Agents with Standing Capillary Waves in the Frequency Range from 10 kc/c to 1.5 Mc/s," ACUSTICA, volume 9, 1959, pages 327–340, specifically page 335). To eject a droplet, an electric field parametrically pumps the liquid such that sufficient energy is imparted to the capillary wave that ejection occurs. To assist pumping, the spatial positions of the crests are preferably stabilized with respect to the container holding the liquid. According to one embodiment, the electric field that pumps the liquid is time varying and synchronized with the motion of the crest. To reduce the effects of the electric field on the ejected droplet, the electric field beneficially drops to zero at about the time that the droplet is ejected. One application of the present invention is in an inventive print head useful for drop-on-demand printing.

BRIEF DESCRIPTION OF THE DRAWINGS

Other aspects of the present invention will become apparent as the following description is read in conjunction with the following drawings, in which.

DETAILED DESCRIPTION OF THE ILLUSTRATED EMBODIMENT

While the present invention is hereinafter described in connection with illustrated embodiment droplet ejectors and in connection with a print head useful for drop-on-demand printing, it is to be understood that the present invention is not limited to that embodiment or application. On the contrary, the present invention includes all alternatives, modifications and equivalents, either now known or as may become known, as may be included within the spirit and scope of the appended claims.

The present invention provides for ejecting droplets from the crests of capillary waves riding on the free surface of a suitable liquid, beneficially a marking fluid such as ink, by using electric fields. According to one embodiment, the amplitudes of the capillary wave crests approach the level at which droplets are self-ejected from the crests, hereinafter referred to as the droplet ejection threshold. The crests are beneficially spatially fixed within the container holding the marking fluid. When a droplet is to be ejected, the marking fluid within the capillary wave is attracted by an electric field such that the attractive force parametrically pumps the fluid to a level whereby a droplet is ejected. The term "parametric pumping" as used herein refers to the adding of energy to the system by forces synchronized with the capillary wave motion. Preferably, the pumping electric field approaches a zero magnitude about the time the droplet is ejected.

THE DROPLET EJECTOR ASSEMBLY

Figure 1:
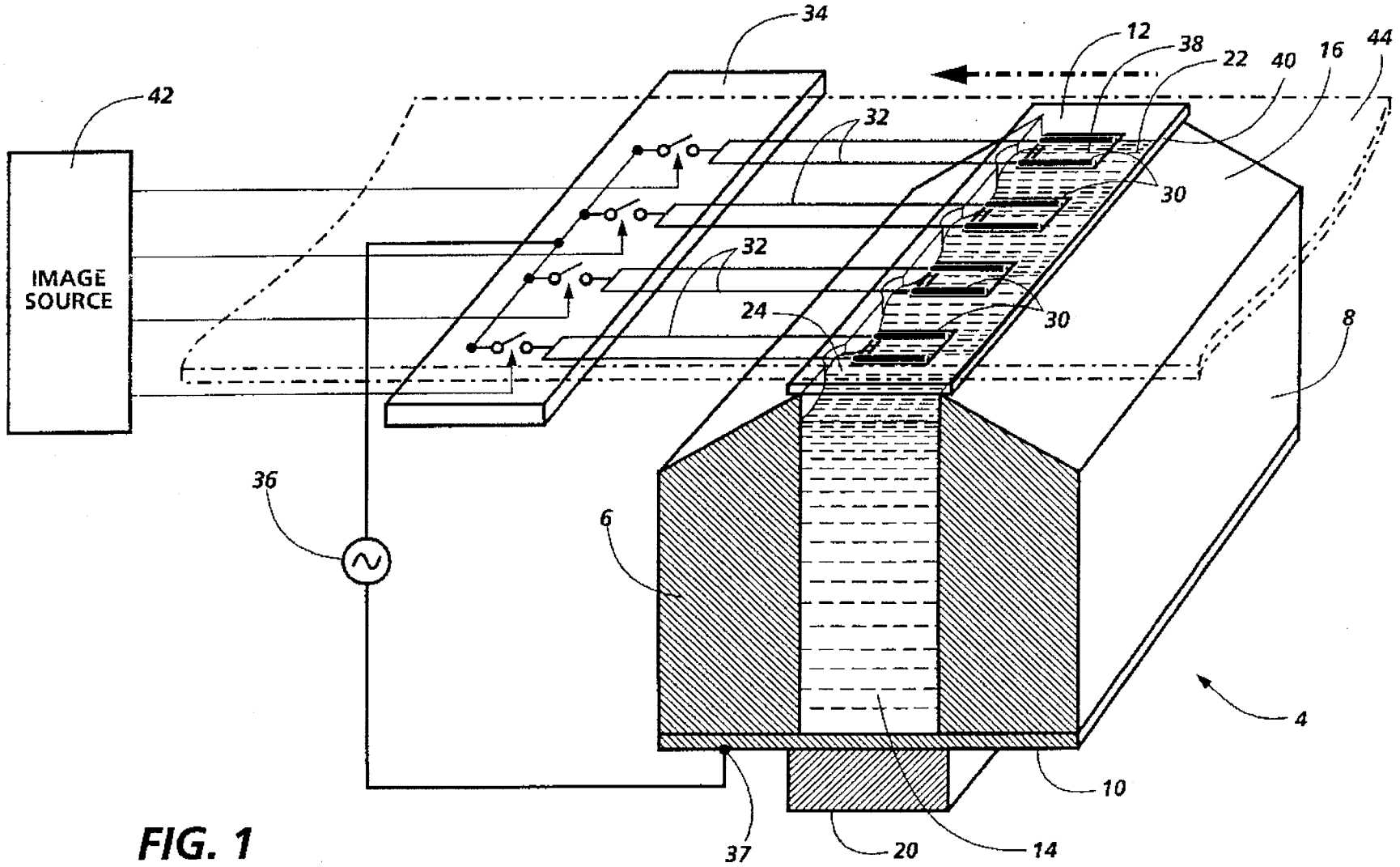
FIG. 1 shows a simplified, fragmentary, isometric view of a plurality of droplet ejectors according to one embodiment of the present invention.

One apparatus for practicing the present invention is shown in FIG. 1, a simplified, fragmentary isometric view of a printer which includes a plurality of individual droplet ejectors. It is to be understood that in the illustrated embodiment that the droplet ejectors are separated by a distance which corresponds to the desired pixel (picture element) resolution of the printer. The droplet ejectors share a common container 4 formed by a first wall 6, a second wall 18, an electrically conductive bottom plate 10, and two ends (not shown). The container 4 has an inner channel 12 formed by the first and second walls and holds a marking fluid 14, such as a water based ink, in the channel. In the embodiment illustrated in FIG. 1, the first and second walls are both slabs of single crystal silicon, each about 8½ inches long by 0.1 inch thick by 0.25 inch high. The top surface 16 of each wall slopes downwardly at about a 15 degree angle to form beveled lips 18 (see FIG. 2), useful in retaining the marking fluid 14 within the channel 12. The walls are arranged with their beveled lips facing each other across the width of the channel 12, typically separated by about 0.1 millimeter.

Figure 2:
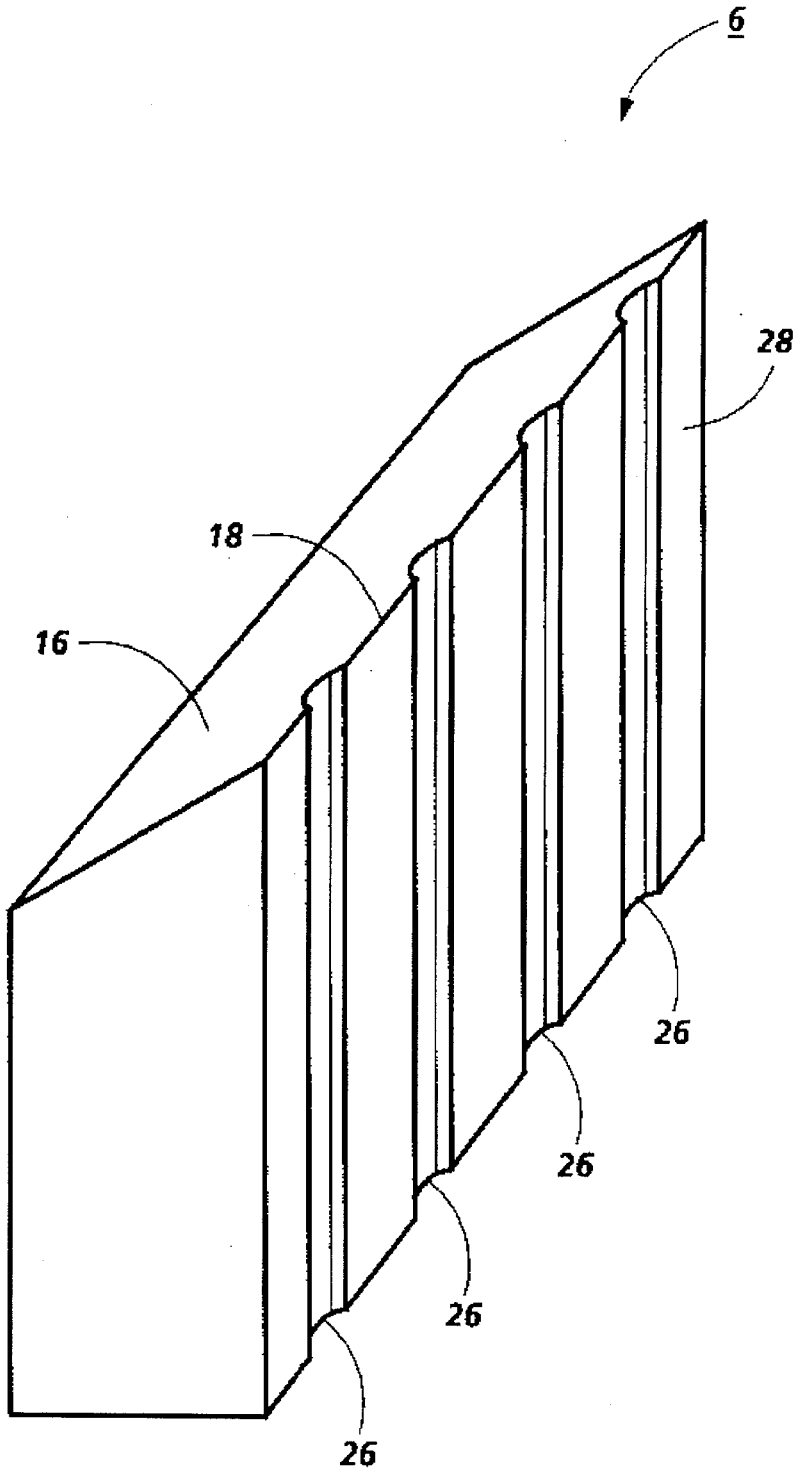
FIG. 2 shows stabilizing grooves for spatially stabilizing the capillary wave crests that are formed into the inner sidewall of the embodiment of FIG. 1.

Still referring to FIG. 1, a transducer 20 generates ultrasonic energy which creates capillary waves on the free surface 22 of the marking fluid 14, as discussed in U.S. Pat. No. 4,719,476. The output of the transducer is beneficially adjusted so that the resulting wave amplitude is slightly below the droplet ejection threshold. Referring now to FIGS. 1 and 2, the resulting capillary wave has a plurality of wave crests 24 which are spatially stabilized within the container 4 by vertical grooves 26 formed into the inner side 28 of the first wall 6. By spatially stabilized it is meant that the crests occur at fixed locations, even though the wave surface varies from a crest to a trough at those fixed locations. In one embodiment these grooves are formed by anisotropic etching. Similar stabilizing grooves are discussed in U.S. Pat. No. 4,719,480.

Figure 3:
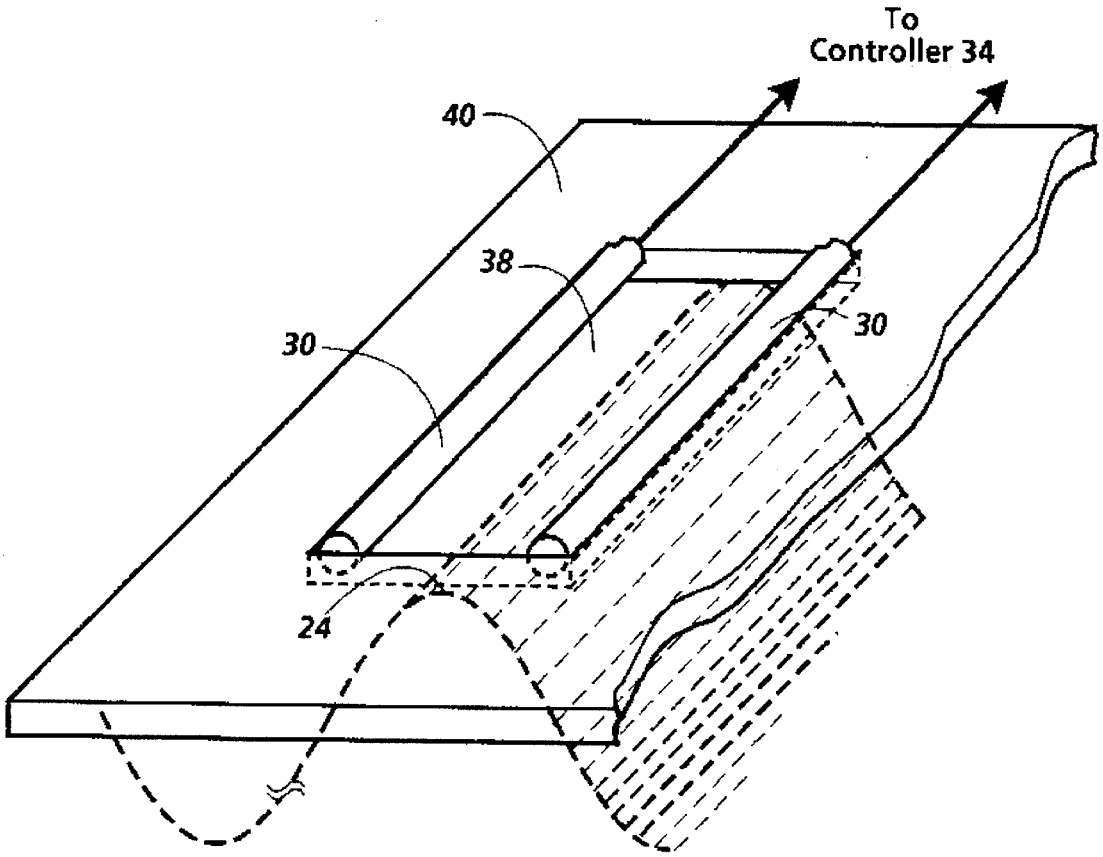
FIG. 3 illustrates the spatial relationship between the capillary wave crests and the probes according to the embodiment of FIG. 1.

Referring now to FIGS. 1 and 3, the individual droplet ejectors also include a pair of electrically conductive probes 30 located such that each probe is slightly above, but on opposite sides, of an associated stabilized crest 24. The probe pairs electrically connect, via wires 32, to a controller 34 which selectively applies voltage from a source 36 to the probe pairs. The source return is through the marking fluid 14 via an electrical connection 37 made with the conductive bottom plate 10. In the embodiment of FIG. 1, the individual probes of a probe pair are mounted within apertures 38 of a fixed, insulating glass plate 40 which is disposed slightly above the container 4. The glass plate helps locate the probes adjacent the crests, white the apertures permit ejected droplets to leave the vicinity of the probes. In response to signals from an image source 42, the controller selectively connects the source 36 to the probe pairs of individual droplet ejectors as required to eject droplets to produce an image on a recording medium 44 as the recording medium passes above the glass plate 40.

THE EJECTION PROCESS

The present invention is meant to be used with a liquid which supports capillary waves. Capillary waves are characterized by having restoring forces dominated by the surface tension of the liquid on which they exist. The liquid used with the present invention must also must be attracted by an electric field. That liquids are attracted to electric field is well known, see, for example, Martin Plonus' work "APPLIED ELECTROMAGNETICS," Chapter 5, 1978 edition. Tests indicate that common tap water in the City of Palo Alto, Calif., having a viscosity of about 0.9 cp (centipoise), a surface tension of about 72 dyne-cm (dynes per centimeter), and an unknown but appreciable conductivity is usable with the inventive method. Additionally, it is believed that a dye-based ink having a surface tension of about 1.6 cp, a viscosity of about 55 dyne-cm, and an unknown but existent conductivity (properties similar to ink commercially available for use with the Hewlett-Packard Deskjet printer) is also usable. Finally, it is believed that the number of liquids usable with the present invention is very large.

To eject a droplet from the embodiment shown in FIG. 1, which includes a capillary wave at an amplitude approaching the droplet ejection threshold, only a relatively small amount of energy need be added to the system. One way to add energy would be to apply a sufficiently high voltage pulse to the probes 30, relative to the conductive plate 10. That voltage would produce an attraction force between the marking fluid 14 in the crest and the probe, thereby inducing some of the fluid to be ejected and pass through the aperture 38.

Figure 4:
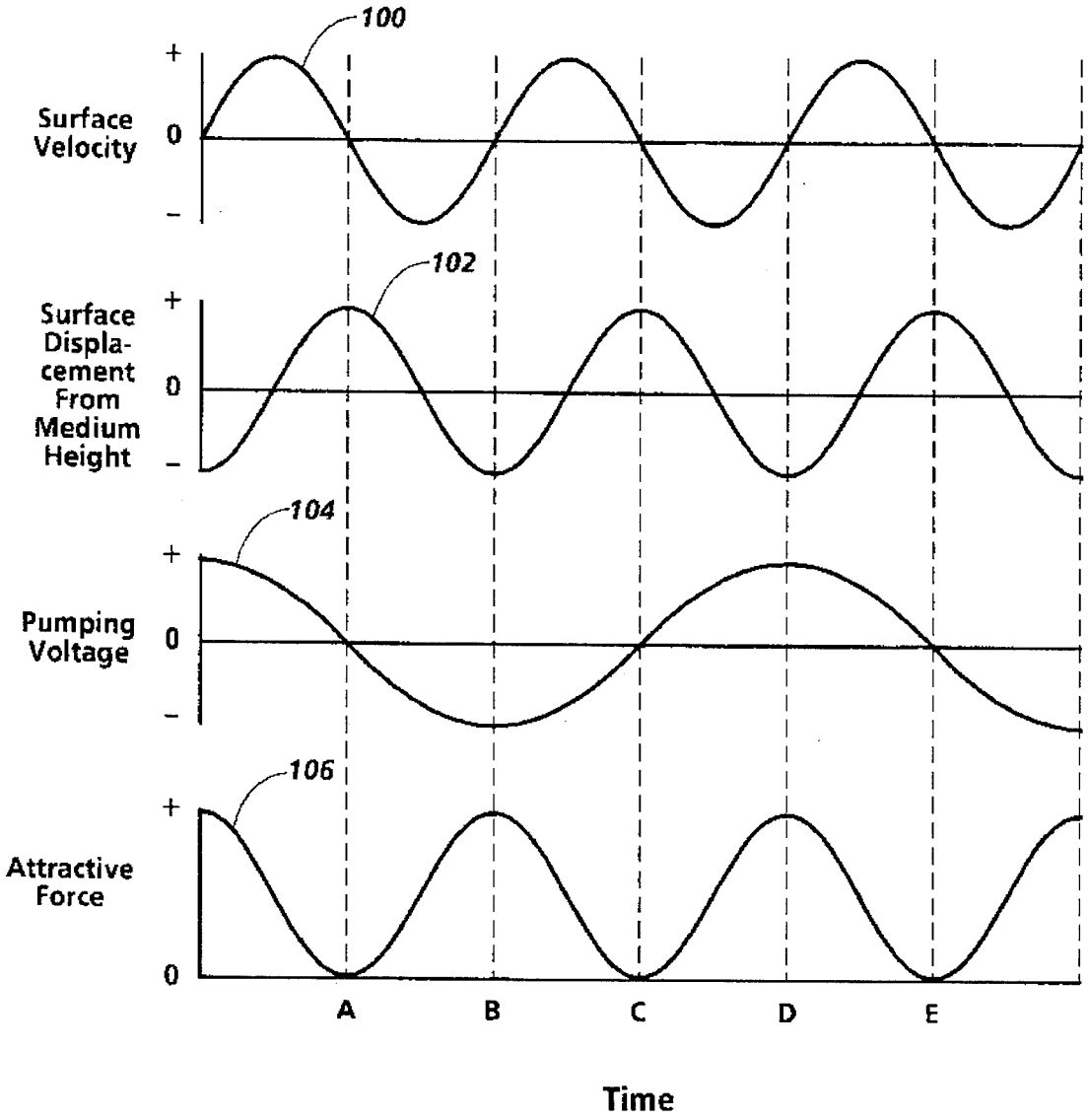
FIG. 4 illustrates the relationship between the wave crest motion, the electric field, and the attractive force produced by the electric field according to the embodiment of FIG. 1.

A way of ejecting droplets is to apply an electric field to the probes 30 which parametrically pumps the marking fluid. One technique for accomplishing this is described with the assistance of the timing diagram of FIG. 4. In FIG. 4, the surface velocity of the capillary wave is illustrated by trace 100 while the surface height of the marking fluid is illustrated by trace 102. As indicated, the capillary wave cyclically rises and falls at positions fixed by the stabilizing grooves, resulting in crests and valleys which occur at intervals dependent upon the capillary wave frequency. To parametrically pump the marking fluid, the source 36 applies an alternating voltage, illustrated by trace 104, to the probes 30, producing electric fields from the probes which pass into the marking fluid 14. The electric field creates an attractive force, illustrated by trace 106, that at a fixed distance from the probes is proportional to the square of the electric field. With reference to FIG. 4, at time A the attractive force between the probes 30 and the marking fluid is zero and the capillary wave surface height is at its maximum. Between times A and B, the attractive force (at a fixed distance from the probes) increases as the surface height falls until the attractive force reaches a maximum when the surface height is at its minimum. Between times A and C, the attractive force draws the marking fluid toward the probes, imparting energy to the system. As shown, the attractive force decreases as the surface height approaches the probes. At time C, about when a droplet is ejected, the attractive force is zero. Provided that the attractive force has imparted sufficient energy to the system, the surface tension of the marking fluid at the crest is overcome and a droplet is ejected. If another droplet is to be ejected, the process repeats as shown by times C, D, and E.

With the probes 30 symmetrically disposed about the crests 24 as illustrated in FIG. 3, the effects of their attractive forces on the crest are substantially additive. This is beneficial because the attractive forces then cause the ejected droplet to pass more or less centrally between the probes and through the aperture 38, provided that sufficient energy has been imparted to the system and that the attractive forces on the droplet are small when the droplet passes the probes.

From the above, it is clear that many factors should be considered when implementing the above described embodiment. The characteristics of the marking fluid, the probe position, the voltage applied to the probes, the intensity and frequency of the ultrasonic energy from the transducer, the synchronization between the voltage applied to the probes and the wave crests, and the depth of the marking fluid all should be balanced.

While the foregoing described an improved method and apparatus for selectively ejecting droplets from capillary waves and the use of the method and apparatus in a printer, it is evident that many alternatives, modifications and variations will be apparent to those skilled in the art. Accordingly, it is intended that the present invention embrace all alternatives, modifications and variations that fall within the spirit and scope of the appended claims.

What is claimed:

1. A method of ejecting a droplet from a liquid having a surface tension and an attractive sensitivity to an electric field, the method comprising the steps of:

generating a capillary wave having a crest and wave motion with a predetermined frequency on a free surface of the liquid; and parametrically pumping the liquid with an electric field such that the surface tension is overcome and the droplet is ejected from said crest.

2. The method according to claim 1, further including the step of stabilizing said crest in a predetermined position.

3. The method according to claim 2, wherein said step of parametrically pumping the liquid includes the step of reducing said electric field substantially to zero about when the droplet is ejected.

4. A method of ejecting a droplet from a free surface of a marking fluid having a surface tension and an attractive sensitivity to an electric field onto a recording surface, the method comprising the steps of:

generating a capillary wave having a crest and wave motion with a predetermined frequency on the free surface of the marking fluid; and parametrically pumping the marking fluid using an electric field to cause a droplet of the marking fluid in said crest to overcome the surface tension and to be ejected onto the recording surface.

5. The method according to claim 4, further including the step of stabilizing said crest in a predetermined position.

6. The method according to claim 5, wherein said step of parametrically pumping the marking fluid includes the step of reducing said electric field substantially to zero about when the droplet is ejected.

7. A droplet ejector for ejecting a droplet from a free surface of a liquid of a type having a surface tension and an attractive sensitivity to an electric field, comprising:

a container for containing the liquid;

means for generating a capillary wave having a crest and a wave motion with a predetermined frequency on the liquid;

means for spatially stabilizing said crest in a position within said container;

an electrically conductive probe disposed near said stabilized crest position; and supply means selectively coupled across said probe and said liquid for selectively generating an attractive electric field from said probe into said liquid which parametrically pumps said liquid to a level sufficient to cause a droplet to overcome the surface tension of the liquid and to be ejected from said crest.

8. The apparatus according to claim 7, wherein said supply means creates a substantially zero electric field near the time the droplet is ejected.

9. A printer of the type having a means for moving a print head relative to a recording medium and a means for producing image control signals associated with an image to be produced, wherein the improvement is a print head comprising:

a container for containing a marking fluid having a surface tension and an attractive sensitivity to an electric field;

means for generating a capillary wave having a crest and a predetermined wave motion on the free surface of the marking fluid;

means for stabilizing said crest in a predetermined position within said container; and probe means for generating a time varying electric field which parametrically pumps the marking fluid such that a droplet is ejected from said crest in response to the image control signals.

10. The printer according to claim 9 wherein the marking fluid is ink.

11. A print head for ejecting a marking fluid characterized by a surface tension and by an attraction to an electric field, comprising:

a container for containing the marking fluid such that said marking fluid has a free surface;

means for generating a capillary wave having a crest on said free surface of the marking fluid;

means for stabilizing said crest in a predetermined position within said container;

probe means associated with said crest for producing an electric field into the marking fluid local to said crest, said probe joined to said container in a substantially fixed position and spatially disposed adjacent the stabilized crest position; and supply means selectively coupled across said probe means and said marking fluid for selectively generating an attractive electric field from said probe means into said marking fluid which parametrically pumps said marking fluid to a level sufficient to cause a droplet to overcome the surface tension of said marking fluid and to be ejected from said crest.

* * * * *